US005377853A

United States Patent [19]

Papciak

[11] Patent Number: 5,377,853

[45] Date of Patent: * Jan. 3, 1995

[54] DECORATION, IDENTIFICATION AND DIFFERENTIATION CLOSURE SYSTEM

[75] Inventor: Charles Papciak, Exton, Pa.

[73] Assignee: The West Company, Incorporated, Lionville, Pa.

[ * ] Notice: The portion of the term of this patent subsequent to Feb. 4, 2011 has been disclaimed.

[21] Appl. No.: 185,402

[22] Filed: Jan. 24, 1994

Related U.S. Application Data

[63] Continuation of Ser. No. 50,851, Apr. 21, 1993, Pat. No. 5,284,263, which is a continuation of Ser. No. 807,458, Dec. 12, 1991, abandoned, which is a continuation of Ser. No. 605,494, Oct. 30, 1990, abandoned.

[51] Int. Cl.[6] ..... A61J 1/00

[52] U.S. Cl. ..... 215/230; 206/459.5; 215/249

[58] Field of Search ..... 40/306, 307, 310, 311, 40/313; 206/459.1, 459.5, 528, 534, 540, 807; 215/230, 249; 220/254, 256, 258

[56] References Cited

U.S. PATENT DOCUMENTS

| | | | |
|---|---|---|---|
| 2,387,955 | 10/1945 | Tilson | 215/249 |
| 3,225,914 | 12/1965 | Klein et al. | 206/459.5 |
| 3,533,371 | 10/1970 | Gronemeyer | 206/534 |
| 4,346,833 | 8/1982 | Bernhardt | 206/459.5 |
| 4,347,804 | 9/1982 | Villa-Real | 206/459.1 |
| 4,390,104 | 6/1983 | Cummings | 215/249 |
| 4,471,879 | 9/1984 | Conor et al. | 215/249 |
| 4,548,157 | 10/1985 | Hevoyan | 206/459.1 |
| 4,562,932 | 1/1986 | Finnern | 215/249 |
| 4,616,750 | 10/1986 | Nouwen | 206/459.5 |
| 4,723,673 | 2/1988 | Tartaglia et al. | 215/230 |
| 4,749,093 | 6/1988 | Trick | 206/534 |
| 4,779,733 | 10/1988 | Kilian | 206/459.5 |
| 4,964,513 | 10/1990 | Ingram et al. | 206/459.5 |
| 5,011,032 | 4/1991 | Rollman | 206/534 |
| 5,248,263 | 2/1994 | Papciak | 215/230 |

*Primary Examiner*—Jimmy G. Foster

*Attorney, Agent, or Firm*—Eugene E. Renz, Jr.

[57] ABSTRACT

A system for pharmaceutical product identification, comprising a closure on a pharmaceutical container, including a cap seal having a dependent skirt and an upwardly facing top. The seal has a first identifying indicia and the removable overcap protecting the closure has a second identifying indicia thereon. The first and second indicia cooperatively conveying information to the user of said container.

2 Claims, 1 Drawing Sheet

DECORATION, IDENTIFICATION AND DIFFERENTIATION CLOSURE SYSTEM

This is a continuation of copending application(s) Ser. No. 08/050,851 filed on Apr. 21, 1993, U.S. Pat. No. 5,284,263 which is a continuation of then copending application Ser. No. 07/807,458 filed Dec. 12, 1991 now abandoned; which is a continuation of Ser. No. 07/605,494 filed Oct. 30, 1990 also abandoned.

FIELD OF THE INVENTION

The present invention relates to a system for product identification, and more particularly to a system for product identification for pharmaceutical products. The invention relates directly to a system for providing direct safety at the point of use of pharmaceutical products.

BACKGROUND OF THE INVENTION

Pharmaceutical products are sold with extensive labeling. Packaging and containers are filled with instructions, warnings, and other information. Goods which can be packaged in vials, such as unit doses of medicaments, are packaged with written instructions inside the box or other package which contains the vial. These vials are intended for use with syringes and are to be applied to the patient at the bedside or other place of treatment.

Typically, nurses will be assigned to give medicines and the like to a number of patients at one period of time. Often times, the administering nurse will have an entire tray or even a cart full of medicines to be given to a part or all of a floor in a hospital. In order to understand the background of the present invention and the environment in which it is intended to be used, it is necessary to visualize a health care worker assembling a cart or tray for a visit to several patients. Typically, the nurse or health care worker will have individual instructions for each patient, and will place those instructions on separate locations on the tray or cart. Reading each set of instructions separately, the health care worker will then place the appropriate medicines from the pharmacy department of the hospital on to the respective instruction sheets or slips of paper.

When tablets or pills are given, they are often placed in disposable cups and one can be relatively certain that the correct patient will be given the correct medicine. Similarly, when medicines are to be given with a syringe, unit dose vials of the correct medicine in the correct amount can be placed on the patient's instruction list or chart and there is every expectation that the appropriate medicine will be delivered to the appropriate patient.

In some instances, however, the medicine which is to be given to the patient will be mixed at the point of administration or use. For example, dilution instructions are often times provided for medicine which, if it is not diluted can cause serious problems. This information is given with the instructions from the Doctor or Pharmacist in most cases. In addition, this information is often printed on the vial label or container itself. Every effort is made to insure that the instructions are followed at the point of administration.

A problem arises when the health care worker relies upon information which is placed on the cap of the container, particularly in containers which have a removable protective cap. These caps are essential to maintain sterile conditions for the medicines, and are designed to be easily removed by a flipping motion of the thumb, while the vial is held in one hand. At that point, the nurse can then add the diluent or perform whatever additional steps are necessary as the medicine is transferred to a syringe and then to the patient. Occasionally, however, the health care worker will remove more than one cap, particularly if a number of treatments are all to be given at one time. Also, even when one medicine is being administered, if it is to be diluted and if the diluent is supplied separately, caps from many containers must be removed. If the container without the cap does not contain the appropriate instructions, or if there is some way for the container to be separated from the cap, thereby losing the instructions, an unnecessary risk is taken.

While every intention is to avoid confusion and haste, sometimes it is unavoidable that the health care worker will have too many patients to treat in too short of time, and the very real possibility exists that the medicine given to a particular patient may not be precisely the treatment which the doctor has prescribed. While sometimes too much or too little diluent may not cause a significant problem, the very real possibility exists that improper administration of medicine can cause serious harm to the patients being treated.

As simple as it sounds, there have been many tragic examples of mistakes being made by health care personnel. These mistakes has caused lives and have endangered the lives of many others. For example, many deaths occur nationally each year because of a mix-up of sodium chloride and potassium chloride which, if not diluted, can cause death. And yet, at the present time, there is no system for product identification of pharmaceutical products and the like which is designed specifically for a point of application treatments. In many instances, where removable outer caps are used for protection of the patient and maintenance of sterile conditions, the cap is placed near the vial. Yet there is no real assurance that the cap and vial match at a later time when the busy health care worker picks up the medicine for a particular patient.

Accordingly, it is an object of this invention to provide additional safety at the point of use of medicines. It is a specific object of this invention to provide a system for pharmaceutical product identification which can be used at the point of application to insure the proper identification and other information be communicated to the nurse or other health care personnel.

SUMMARY OF THE INVENTION

It has now been discovered that the above and other objects of the present invention may be accomplished in the following manner. Specifically, a new system for pharmaceutical product identification has been developed. The system includes a closure on a pharmaceutical container, including an aluminum cap seal which has a first identifying indicia. Also provided is a removable overcap protecting the closure and having a second identifying indicia. The first and second indicia cooperatively convey information to the user of the container.

Examples of information which is conveyed by the first and second indicia are safety messages, identical messages, dosage messages, restriction on use warnings, color codings and other instructions. In addition, the indicia may convey contents, brand names, dosage strengths and other information.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
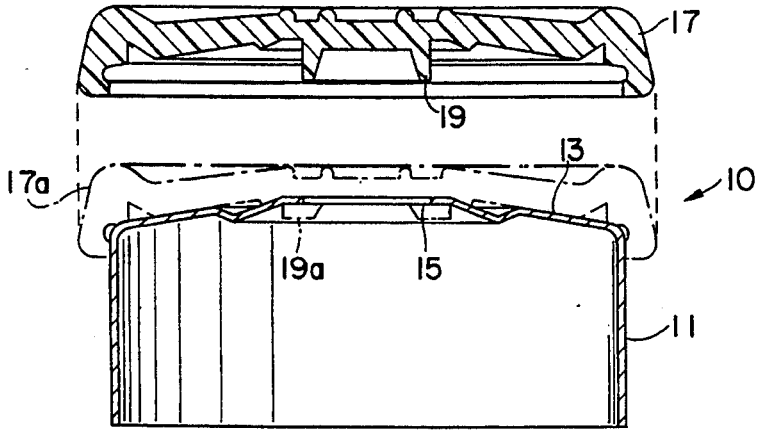
FIG. 1 is an enlarged elevational view of one embodiment shown is section illustrating the attachment of a removable overcap onto a closure shell.

As shown in FIG. 1, the system of the present invention includes a device, shown generally by the reference numeral 10, which includes, among other parts of the closure system, a cap seal 11 which is normally made from aluminum. The cap seal includes a top 13, on which a first identifying indicia may be placed. The top terminates inwardly at the center hole 15 which is designed to accept the overcap 17. Overcap 17, shown in FIG. 1, is typically a plastic button like member which has been formed or molded from plastic and which contains a second identifying indicia. The annular dependent ring 19 is sized to fit hole 15 and, during assembly, is formed outward, shown at 19*a* as the dot and dash view of cap 17*a* fits on top 13. This entire assembly is then placed on a rubber stopper or other closure. When the cap 17*a* is desired to be removed, the health care worker merely presses upward against the cap 17*a*, fracturing frangible portions and exposing the top 13.

Figure 2:
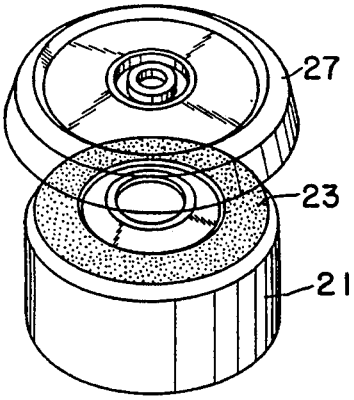
FIGS. 2–5 are perspective, exploded views of different embodiments of the present invention.

Shown in FIG. 2 is a pharmaceutical product identification system in which the cap 21 is plain and the top 23 has been colored. Overcap 27 is clear, thereby allowing the information contained on the top to be seen both before and after removal of cap 27. This ensures that the health care worker using this system will have whatever information is desired by the pharmacist, drug manufacturer, or physician, as need be, before and after the cap is removed.

Figure 3:
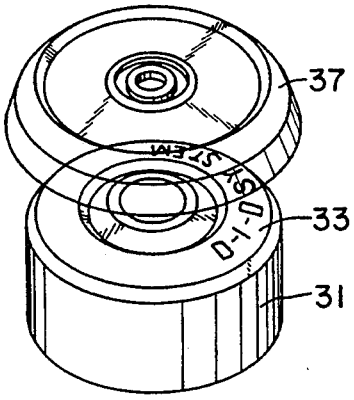

Similarly, in FIG. 3, the plain cap 31 has printed information such as advertising or instruction such as "must be diluted", for potassium chloride. This information is placed on top 33 which is visible through clear cap 37, both before and after the cap 37 has been removed. In this case, whether color coding or information is important for the user, that information can be relayed without any possibility of the information being thrown away with the cap.

Figure 4:
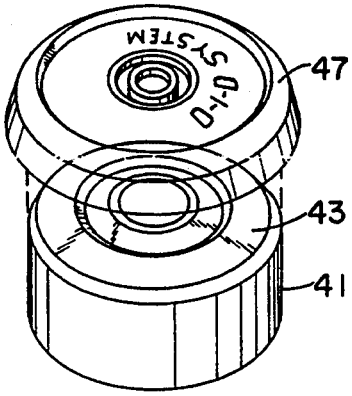

In FIG. 4, a plain cap 41 with a plain top 43 include a printed cap 47 which is primarily for advertising purposes in this example.

Figure 5:
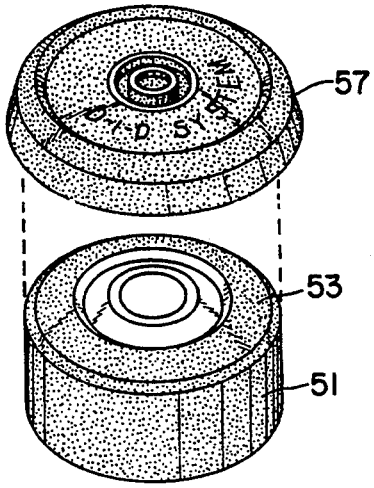

In FIG. 5, a colored cap 51 and colored shoulder 53 are matched with a similarly colored cap 57. In this case, the information is contained on cap 57, but the similarity of color coding allows the health worker to match the cap to the appropriate vial or container, even after the cap 57 has been removed. Of course, the vials, not shown, to which the seal and cap are added may be clear or the same or different colors from the seal and/or cap.

In each case, the information conveyed by the first identifying indicia on the cap seal is cooperatively combined with the information conveyed by the indicia on the removable overcap, to provide a failsafe redundancy of information at the point of use of the container to which they are applied.

As has been noted, safety messages such as the appropriate material for dilution or the quantity of dilution can be conveyed with both the first and second indicia, either duplicating the information or combining to convey that information. Extra assurances are given when the same message is on both the cap and the top of the container seal. Similarly, restrictions on use or other warnings can be used. For example, the cap may state that dilution is required while the seal top may state that the contents cannot be used without dilution.

In the preferred embodiment, cap 17 may be manufactured from plastic such as polypropylene or other similar plastics. The specific material is not critical, as long as other functional requirements are met. The plastic should be suitable for receiving printing or other information after formation, and such be susceptible to being colored prior to manufacture. Similarly, the seal can be made from a number of materials, although aluminum is the preferred material since it is suitable for application of colors through dies and lacquers, and since it is receptive to printing.

It is particularly important that the product be immediately and visually identified. Messages, instructions or warnings must be highly visible and for that reason the printing process must be sufficient to clearly define the color and/or information which is intended to be placed on either the cap, under seal, or both. The colors should be easily duplicated, particularly since the cap and seal are often made at different points in the manufacturing process. The products should be autoclavable, and thus would stand temperatures in excess of 121° C. for sufficient time to sterilize the products. It should be noted that the information added to the products by the present invention are on the exterior and are never in contact with the contents of the vial. Accordingly, there is no reason for expensive qualification testing and the like.

While particular embodiments of the present invention have been illustrated and described herein, it is not intended to limit the invention. Changes and modifications may be made therein within the scope of the following claims.

What is claimed is:

1. A closure for containers for pharmaceutical products comprising a cap seal having a top and a depending skirt, a removable overseal overlying the top of the cap seal and removably mounted thereto, means defining color indicia and instructive indicia on the top of the cap seal and the overseal including characters which contrast in color with the surface on which the characters are placed on said cap seal and said overseal and with the color indicia on the cap seal being the same as the color indicia on the overseal.

2. A closure for containers for pharmaceutical products comprising a cap seal having a top and a depending skirt, a removable overseal overlying the top of the cap seal and removably mounted thereto, means defining color indicia and instructive indicia on the top of the cap seal and the overseal including characters which contrast in color with the surface on which the characters are placed on said cap seal and said overseal and with the color indicia on the cap seal being different from the color indicia on the overseal.

* * * * *